United States Patent [19]

Osa et al.

[11] 4,269,674

[45] May 26, 1981

[54] METHOD OF PREPARING PARA-CHLOROTOLUENE

[75] Inventors: Tetsuo Osa, Sendai; Masamichi Fujihira, Sendai; Tomokazu Matsue, Sendai; Takashi Yamauchi, Tokyo, all of Japan

[73] Assignee: Kureha Kagaku Kogyo Kabushiki Kaisha, Tokyo, Japan

[21] Appl. No.: 101,917

[22] Filed: Dec. 10, 1979

[30] Foreign Application Priority Data

Dec. 22, 1978 [JP] Japan ..... 53-160611

[51] Int. Cl.[3] ..... C25B 3/06

[52] U.S. Cl. ..... 204/81; 204/294

[58] Field of Search ..... 204/78, 81, 294

[56] References Cited

U.S. PATENT DOCUMENTS 3,692,646 9/1972 Mather et al. .

*Primary Examiner*—R. L. Andrews

*Attorney, Agent, or Firm*—Wegner & Bretschneider

[57] ABSTRACT

A method of preparing para-chlorotoluene by the electrolytic chlorination of toluene in an aqueous solution of hydrogen chloride or a metal halide as an electrolyte by passing an electric current from a cathode to an anode, both of which are immersed in the electrolyte, in order to form an active chlorine species which then reacts with toluene to produce the desired para-toluene. The anode is made of a carbonaceous material having cyclodextrin or a derivative thereof bonded onto its surface. The toluene that is introduced into the aqueous solution of electrolyte is included as a clathrate compound within the cyclodextrin.

5 Claims, 3 Drawing Figures

METHOD OF PREPARING PARA-CHLOROTOLUENE

BACKGROUND AND DETAILED DESCRIPTION OF THE INVENTION

This invention relates to a novel method for preparing para-chlorotoluene.

Para-chlorotoluene is a useful organo-synthetic intermediate, and particularly it proves to be an important compound as an intermediate for the production of agricultural chemicals.

For industrial preparation of para-chlorotoluene, there is known a method in which toluene is reacted with chlorine in the presence of a catalyst. Iron chloride is well known as a catalyst for substituting chlorine in the aromatic ring, and toluene is reacted with an equivalent amount of chlorine in the presence of such iron chloride. The composition of the reaction product, as for instance mentioned in Japanese Patent Publication No. 8302/67, usually comprises 13% of unreacted toluene, 48% of ortho-chlorotoluene, 22% of para-chlorotoluene, 3% of meta-chlorotoluene and 14% of poly-chlorotoluenes, and selectivity to para-chlorotoluene is very poor.

Japanese Patent Publication No. 8302/67 shows a method in which toluene is chlorinated by using iron halide and sulfur halide in combination. The ratio of para to ortho is 50:50 at most.

Japanese Patent Publication No. 26775/67 suggests chlorination of toluene by using platinum oxide as catalyst. According to this method, the ratio of para to ortho is approximately 53:47.

Thus, the conventional methods of producing para-chlorotoluene had the disadvantages in that a large amount of ortho-isomer is by-produced and that it was required to use a catalyst such as iron chloride or dangerous chlorine gas. Hence these methods were not always satisfactory for the production of para-chlorotoluene.

This invention intends to give a fundamental solution to these problems of the conventional methods and has for its object to provide a method of mono-chlorinating toluene with extremely high selectivity to para-chlorotoluene.

The attainment of this invention is based on a new and noteworthy finding that when chlorination is carried out through an electrolytic reaction by using a carbonaceous electrode having fixed thereon cyclodextrin (Schardinger dextrin: $(C_6H_{10}O_5)_{6-8}$) and by making use of the fact that when such fixed cyclodextrin includes toluene therein, there can be accomplished chlorination with high selectivity to para-isomers.

Figure 2:
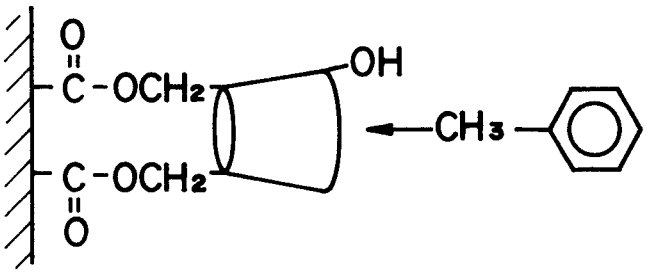
Figure 1:
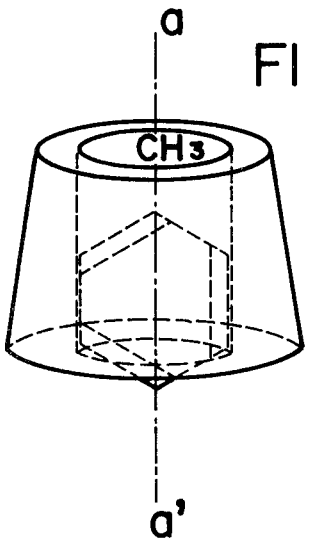
Figure 3:
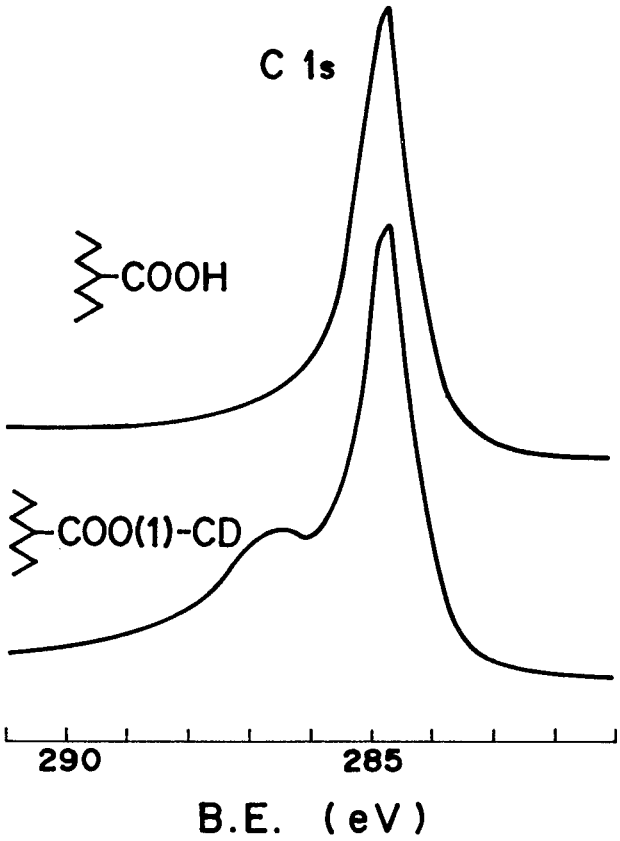

In the accompanying drawings,

FIG. 1 is a diagrammatic illustration of inclusion of toluene by α-cyclodextrin;

FIG. 2 diagrammatically illustrates a mode of inclusion in which toluene is included in α-cyclodextrin fixed to the electrode by ester bonds;

FIG. 3 is a graphic representation of the results of an electron-spectroscopical chemical analysis of a graphite electrode having a carboxyl group and a graphite electrode with fixed α-cyclodextrin.

This invention is now described in detail. Inclusion of toluene by α-cyclodextrin is one of the important factors of this invention. In the case of toluene, as diagrammatically illustrated in FIG. 1, it is included in such a form that the ortho-positions and meta-positions of the methyl group are blocked, so that the para-position alone is predominantly attacked by chlorine.

There are known three types of cyclodextrin: α, β and γ. Although each of these three types has an including function, α-cyclodextrin ($(C_6H_{10}O_5)_6$) is most preferred for increasing selectivity to the para-position. It is known that the ring inner diameter of α-cyclodextrin is approximately 6 Å. As the size of the benzene ring included therein, it is known that the diameter of the cylinder formed by revolving the ring about the axis a—a′ in FIG. 1 is approximately 6 Å. Therefore, there exists little space between the inner wall of α-cyclic dextrin and the included benzene ring, thus the para-position alone opens to attack by chlorine.

Another significant feature of this invention is that the electrolytic reaction can be accomplished in a fixed-bed style as α-cyclodextrin is fixed to the electrode. Further, the reaction operation is easy to carry out, and the regulated orientation of toluene on the electrode surface is conducive to cause to increase in the ratio of the para-isomer. It is assumed that α-cyclodextrin is fixed to the electrode by two methylol groups (—$CH_2O$—) at the end with smaller diameter as shown in FIG. 2. Since the inside of α-cyclodextrin is a electronegative field with high electron density, it is considered that toluene is included with the electron-donating methyl group being placed at the top. Therefore, the para-position is directed outwardly relative to the electrode surface and hence apt to attack by chlorine.

The use of an electrode having α-cyclodextrin fixed thereon by means of bonding or adsorption has the advantage of the improved selectivity to the para-position and the elevated reaction rate owing to the synergy of the including effect of α-cyclodextrin and the effect of the electrolytic reaction. Toluene may be chlorinated in an inorganic chloride aqueous solution or a hydrochloric acid aqueous solution by using a non-treated carbonaceous electrode to which no α-cyclodextrin is yet bonded. However, when this invention is followed, the ratio of para-position/ortho-position can be significantly increased as compared with the conventional methods. This indicates evidently the effect of use of the electrode of this invention. It was also found that para-chlorotoluene can be obtained by chlorination of toluene with hypochlorous acid in an aqueous solution of α-cyclodextrin, but the results achieved are not as favorable as those of the claimed invention.

It was ascertained that the method of this invention is capable of producing the para-substituent with a far higher selectivity than the selectivity achieved by a chlorination reaction singly using either of said reaction means. This is interpreted as the synergistic effect of inclusion of toluene in α-cyclodextrin and the electrolytic reaction in this invention. When chlorination is performed, for example, with hypochlorous acid in an α-cyclodextrin aqueous solution, the para/ortho (P/O) ratio is on the order of 1 to 2, even if α-cyclodextrin is used in 10 times the amount as toluene by mole. According to the method of this invention, it is possible to readily obtain as high a P/O ratio as about 4 to 5 even when toluene is present in large excess.

At present time, no light has been shed on the detailed reaction mechanism which brings about such effect. In case of using the electrode on which is fixed α-cyclic dextrin, it is supposed that said effect is due to the attack on toluene which is included with high density and with fixed orientation on the electrode surface. In view of this and the fact that the amount of α-cyclodextrin may be an extremely little, the α-cyclodextrin fixed on the electrode may be regarded as a sort of catalyst. In fact, the method of this invention requires no catalyst such as iron halide, which is essential in the conventional methods, and is capable of producing para-chlorotoluene with high selectivity by merely supplying an inorganic chloride or hydrochloric acid aqueous solution as an electrolytic and toluene into an electrolytic cell and supplying an electric current thereto.

Preparation of an electrode fixed with the α-cyclodextrin used in this invention is now described. There are available two methods for fixing α-cyclodextrin on a carbonaceous electrode: fixing by adsorption and fixing by chemical bonding. Either of these methods can be equally well employed for forming an electrode fixed α-cyclodextrin.

For fixing α-cyclodextrin on a carbonaceous electrode by means of chemical bonding, first a functional group is produced on the electrode surface by a pre-treatment and then such functional group is reacted with α-cyclodextrin or a derivative thereof to form chemical bonds.

Said pre-treatment may be accomplished by one of the following methods: a carboxyl group is produced by oxidation; such group is changed to acid chloride or reduced into a hydroxymethyl group; said group is nitrated and then reduced into an amino group; or a —MgCl group is produced.

The produced functional group is reacted with α-cyclodextrin or a derivative thereof to form a chemical bond. Such chemical bonds may be an ester bond, an amide bond, ether bond or a carbon-carbon bond. Examples of the α-cyclodextrin derivatives are chlorides and amino or tosyl compounds.

A method of producing a carboxyl group and then forming an ester bond is described below. The carbonaceous electrode used here may be either a carbon electrode or a graphite electrode, and the configuration thereof may be either plate-shaped or cylindrical. This electrode is oxidized to produce a carboxyl group on the electrode surface. As the oxidizing agent, there may be used potassium bichromate, potassium permanganate, nitric acid, sodium hypochlorite or heated air. In case of using potassium permanganate, said electrode is immersed in an aqueous solution consisting of 0.1 to 1.0 mol/l of potassium permanganate and 0.1 to 1.0 mol/l of sulfuric acid at 0°–50° C. for 5 minutes to 3 hours, thereby obtaining a carbonaceous electrode having carboxyl groups formed on its surface. Then said carboxyl group is converted into a —COCl group. Thionyl chloride, phosphorus trichloride, phosphorus pentachloride or such may be used as chlorinating agent. In case of using thionyl chloride, said electrode is immersed in said thionyl chloride and heated under reflux for 10–50 hours, whereby there can be obtained an electrode having a —COCl group.

Then said —COCl group is reacted with α-cyclodextrin. This may be accomplished by dissolving or dispersing α-cyclodextrin in a suitable solvent and then immersing therein the electrode having said —COCl group. The solvent used in this reaction needs to be basic, and there may be used pyridine or a derivative thereof, quinoline or a derivative thereof, aliphatic or aromatic tertiary amines or the like as said solvent. It is also possible to use dimethyl sulfoxide in combination with said solvent so as to further increase solubility. In case of using pyridine, 2 g of α-cyclodextrin is suspended in 50 ml of pyridine and then said electrode is immersed therein and reacted under refluxing for 1–5 days.

Also in this invention, an electrode with an α-cyclodextrin adsorbed thereto may be used. The electrode may be obtained by immersing a non-treated electrode or an electrode having a carboxyl group in an aqueous solution of α-cyclodextrin. In this case, said electrode is immersed in an α-cyclodextrin solution at a room temperature for about one day.

The method of predominantly chlorinating the para-position by using an electrode on which is fixed α-cyclic dextrin obtained in the manner explained above is now described.

The shape of the electrolytic cell as a reactor is not critical, and it is possible to use any type of electrolytic cell provided that it has an anode chamber and a cathode chamber separated by a membrane, that there are provided a stirrer and a reference electrode, and that the electrolytic cell is made of an anticorrosive material. As electrolyte, there may be used an aqueous solution of an inorganic chloride or hydrochloric acid. As inorganic chloride, there are preferably used chlorides of alkaline metals and/or alkaline earth metals, such as lithium chloride, sodium chloride, potassium chloride, calcium chloride, magnesium chloride, barium chloride, etc. Such inorganic chlorides and hydrochloric acid can serve not only as a chlorine source but also as a supporting electrolyte. It is sufficient to use the electrolyte in the amount required to flow an electric current, and usually it is used in a concentration of 0.1 to 1 mol/l. An aqueous solution of said inorganic chloride or hydrochloric acid is placed in an electrolytic cell and the electrode on which is fixed α-cyclodextrin is set as the anode and a graphite or metal electrode as the cathode. Toluene, which is a reactant is supplied on the anode side. Then an electric current is supplied between said both electrodes. It is essential that the potential applied to the anode is higher than the oxidation potential of the inorganic chloride or hydrochloric acid, which is the chlorine source, and lower than the oxidation potential of toluene and chlorotoluene. When a saturated calomel electrode (SCE) is used as reference electrode, the anode potential is preferably within the range of +1.0 to +1.5 volts. When the reaction temperature is lower, the including performance of α-cyclic dextrin is greater. Since the influence of temperature on the reaction rate is small, it is desirable to perform the reaction at a temperature as low as possible. Usually, the reaction is carried out at −20° to +50° C., preferably at −10° to +30° C., under atmospheric pressure.

According to the method of this invention, even if the conversion is increased, selectivity to the mono-chloride and para-isomer remains high. Selectivity to para-isomer may be further elevated by lowering the reaction rate.

The reaction time varies depending on the toluene charge and current strength. Since the conversion is proportional to current strength, the reaction time can be optionally decided according to the reaction rate.

After completion of the reaction, the anode solution is allowed to stand still to separate the oil layer or is extracted with a suitable solvent, and then para-chlorotoluene is separated by a usual means such as distillation, crystallization, etc. It is possible to perform the method of this invention continuously.

The invention is now described in further detail by means of the following examples which are however merely illustrative and not restrictive of the scope of the invention.

EXAMPLE 1

(A) A graphite electrode (a product of Tokai Carbon Co., Ltd., measuring 20×30×2 mm) was immersed in a potassium permanganate-sulfuric acid aqueous solution (potassium permanganate, 0.2 mol/l; sulfuric acid, 0.4 mol/l) and oxidized at room temperature for 30 minutes. After the oxidizing reaction, the electrode was washed with water and dried, and the amount of formed carboxyl group on the electrode surface was quantified. It was $10^{-9}$ mol/cm$^2$. Then the electrode was immersed in thionyl chloride and reacted under refluxing for one day to convert the carboxyl group into a —COCl group. Said electrode was then immersed in a suspension of 2 g of α-cyclodextrin in 50 ml of pyridine and reacted under refluxing for one day. After washing with water and drying, the electrode surface was examined by the electron spectroscopy of chemical analysis (ESCA), obtaining the results shown in FIG. 3. In the graph of FIG. 3, the strength of X-rays applied is indicated on the abscissa and the kinetic energy of the emitted electrons is indicated on the ordinate. Examining the electrons of Cls orbital, it is noted that in the case of graphite having carboxyl groups, there is a peak at bond energy of 285 eV, while in the case of α-cyclodextrin-graphite, there are peaks at 285 eV and at 286.5 eV, indicating bonding of α-cyclodextrin. There was thus obtained an α-cyclodextrin-bonded graphite electrode.

(B) 120 ml of a saline solution with concentration of 0.5 mol/l was charged into a galss-made H type electrolytic cell using a glass filter as separating membrane (anode chamber capacity, 120 ml; cathode chamber capacity, 50 ml) such that 80 ml of said saline solution was charged to the anode chamber and 40 ml of said solution was charged to the cathode chamber. Then this electrolytic cell was provided with the previously produced α-cyclodextrin-fixed electrode as anode, a graphite electrode (15×20×2 mm) as cathode and a saturated calomel electrode as reference electrode. 0.173 g (1.88 mmol) of toluene was put into the anode chamber, and while vigorously stirring the anode solution by a magnetic stirrer, an electric current was supplied by controlling the potential such that the anode potential at 20° C. would become +1.25 volts VS. the reference electrode. The amount of the current supplied between both electrodes was 23 mA and the voltage across the electrodes was 3.4 volts. The current supply was stopped 30 minutes later, the anode solution was extracted with ether and, after concentration, the ether layer was analyzed by gas chromatography. The results are shown in Table 1.

TABLE 1

| | | |
|---|---|---|
| Toluene | 91.1% | |
| Ortho-chlorotoluene | 1.5% | |
| | | (para/ortho = 4.60) |
| Para-chlorotoluene | 6.9% | |
| Poly-chlorotoluene | 0.5% | |

EXAMPLE 2

The same reaction as Example 1 except for the reaction time of 4 hours and 30 minutes was carried out to obtain the results shown in Table 2.

TABLE 2

| | | |
|---|---|---|
| Toluene | 10.2% | |
| Ortho-chlorotoluene | 15.8% | |
| | | (para/ortho = 4.11) |
| Para-chlorotoluene | 65.0% | |
| Poly-chlorotoluene | 9.0% | |

COMPARATIVE EXAMPLE 1

The reaction of Example 1 was repeated but by using a non-treated graphite electrode as anode, obtaining the results shown in Table 3.

TABLE 3

| | | |
|---|---|---|
| Toluene | 90.5% | |
| Ortho-chlorotoluene | 4.6% | |
| | | (para/ortho = 0.93) |
| Para-chlorotoluene | 4.3% | |
| Poly-chlorotoluene | 0.8% | |

COMPARATIVE EXAMPLE 2

120 ml of a saline solution (0.5 mol/l) was charged into an electrolytic cell same as used in Example 1, with 80 ml of said saline solution being given in the anode chamber and 40 ml in the cathode chamber. Then 1.0 g of α-cyclodextrin and 0.2 ml of toluene were added into the anode chamber and dissolved. Said electrolytic cell were provided with a 20×30×2 mm non-treated graphite electrode as anode, a 15×20×2 mm non-treated graphite electrode as cathode, and a saturated calomel electrode as reference electrode, and while stirring the anode solution by a magnetic stirrer, and electric current was applied such that the anode potential at 20° C. would become +1.2 V VS. the reference electrode. The current applied between both electrodes was 24 mA. The current supply was stopped 40 minutes later, the anode solution was extracted with ether, and the ether layer, after concentration, was analyzed by gas chromatography, obtaining the results shown in Table 4.

TABLE 4

| | | |
|---|---|---|
| Toluene | 86.1% | |
| Ortho-chlorotoluene | 3.4% | |
| | | (para/ortho = 2.71) |
| Para-chlorotoluene | 9.2% | |
| Poly-chlorotoluene | 1.3% | |

COMPARATIVE EXAMPLE 3

100 ml of water, 1.0 g (1.03 mmol) of α-cyclodextrin and 0.01 g (0.11 mmol) of toluene were put into a 200 ml three-necked flask provided with a stirrer and a dropping funnel and said materials were dissolved. The α-cyclodextrin/toluene molar ratio was 9.4:1. To this solution was added dropwise 50 ml of a $10^{-2}$ mol/l hypochlorous acid solution (pH 4.7) at room temperature over the period of 30 minutes. Stirring was continued after the end of this dropwise addition, and 12 hours thereafter, the reaction solution was extracted with ether and the ether layer, after concentration, was analyzed by gas chromatography. The results are shown in Table 5.

TABLE 5

| | | |
|---|---|---|
| Toluene | 3.3% | |
| Ortho-chlorotoluene | 3.2% | |
| | | (para/ortho = 1.38) |
| Para-chlorotoluene | 4.4% | |

TABLE 5-continued

| | |
|---|---|
| Poly-chlorotoluene | 89.1% |

COMPARATIVE EXAMPLE 4

The reaction was carried out in the same way as Comparison Example 3 except that no α-cyclodextrin was added, obtaining the results shown in Table 6.

TABLE 6

| | | |
|---|---|---|
| Toluene | 3.7% | |
| Ortho-chlorotoluene | 3.8% | |
| | | (para/ortho = 0.68) |
| Para-chlorotoluene | 2.6% | |
| Poly-chlorotoluene | 89.9% | |

This comparative example is inferior to Comparative Example 2 in the para/ortho ratio. This evidently corroborates the effect of the electrode reaction.

EXAMPLE 3

The reaction process of Example 1 was repeated but by setting the reaction temperature at 0° C. to obtain the results shown in Table 7.

TABLE 7

| | | |
|---|---|---|
| Toluene | 91.6% | |
| Ortho-chlorotoluene | 1.4% | |
| | | (para/ortho = 4.71) |
| Para-chlorotoluene | 6.6% | |
| Poly-chlorotoluene | 0.4% | |

EXAMPLE 4

The reaction of Example 1 was performed by using 0.5 N hydrochloric acid as electrolyte to obtain the results shown in Table 8.

TABLE 8

| | | |
|---|---|---|
| Toluene | 89.3% | |
| Ortho-chlorotoluene | 1.9% | |
| | | (para/ortho = 4.05) |
| Para-chlorotoluene | 7.7% | |
| Poly-chlorotoluene | 1.1% | |

EXAMPLE 5

The reaction of Example 1 was carried out by using a 0.5 mol/l calcium chloride solution as electrolyte to obtain the results shown in Table 9.

TABLE 9

| | | |
|---|---|---|
| Toluene | 88.1% | |
| Ortho-chlorotoluene | 2.2% | |
| | | (para/ortho = 3.95) |
| Para-chlorotoluene | 8.7% | |

TABLE 9-continued

| | |
|---|---|
| Poly-chlorotoluene | 1.0% |

EXAMPLE 6

A 20×30×2 mm graphite electrode was immersed in an α-cyclodextrin solution (0.1 mol/l) for 24 hours, then washed with water and dried to obtain an α-cyclodextrin-adsorbed electrode, and chlorination of toluene was performed by using this electrode as anode in the same way as Example 1, obtaining the results shown in Table 10.

TABLE 10

| | | |
|---|---|---|
| Toluene | 88.3% | |
| Ortho-chlorotoluene | 2.1% | |
| | | (para/ortho = 4.19) |
| Para-chlorotoluene | 8.8% | |
| Poly-chlorotoluene | 0.8% | |

What is claimed is:

1. A process for electrolytically chlorinating toluene to produce p-chlorotoluene in an aqueous solution of hydrogen chloride or an inorganic chloride as an electrolyte by passing electric current from a cathode to an anode immersed in said solution of electrolyte whereby an active chlorine species is formed and reacts with toluene to produce the desired p-chlorotoluene, said anode being of a carbonaceous material having cyclodextrin or a derivative thereof bonded onto the surface thereof, wherein toluene is introduced into said aqueous solution of electrolyte so that said toluene is included as a clathrate compound within said cyclodextrin or derivative thereof, and said electric current is passed at a potential higher than the oxidation potential of hydrogen chloride in said aqueous solution but lower than the oxidation potential of toluene.

2. A process according to claim 1, wherein said carbonaceous material is a carbon electrode or a graphite electrode.

3. A process according to claim 1, wherein said anode is prepared by oxidizing the surface of said carbonaceous material formulated in a shape of electrode to introduce carboxyl groups into the thus oxidized surface thereof, and after converting said carboxyl groups into chloroformyl groups or hydroxymethyl groups, chemically bonding said groups to said cyclodextrin or derivative thereof.

4. A process according to claim 1 or 3, wherein the cyclodextrin is α-cyclodextrin.

5. A process according to claim 4, wherein said inorganic chloride is selected from the group consisting of alkali metal and alkaline earth metal chlorides.

* * * * *